US006485354B1

(12) United States Patent
Wolf

(10) Patent No.: US 6,485,354 B1
(45) Date of Patent: Nov. 26, 2002

(54) POLISHING PAD WITH BUILT-IN OPTICAL SENSOR

(75) Inventor: Stephan H. Wolf, Los Osos, CA (US)

(73) Assignee: Strasbaugh, San Luis Obispo, CA (US)

( * ) Notice: Subject to any disclaimer, the term of this patent is extended or adjusted under 35 U.S.C. 154(b) by 115 days.

(21) Appl. No.: 09/590,470

(22) Filed: Jun. 9, 2000

(51) Int. Cl.[7] ..... B24B 49/00
(52) U.S. Cl. ..... 451/6; 451/41
(58) Field of Search ..... 451/5, 6, 41, 285, 451/287, 288, 289, 397, 398, 290, 286, 8, 9, 10

(56) References Cited

U.S. PATENT DOCUMENTS

| | | | | |
|---|---|---|---|---|
| 5,081,796 A | | 1/1992 | Schultz | |
| 5,838,447 A | | 11/1998 | Hiyama et al. | 356/381 |
| 5,893,796 A | | 4/1999 | Birang et al. | |
| 5,913,713 A | | 6/1999 | Cheek et al. | 451/41 |
| 5,949,927 A | | 9/1999 | Tang | |
| 5,964,643 A | | 10/1999 | Birang et al. | 451/6 |
| 6,012,967 A | | 1/2000 | Satake et al. | 451/36 |
| 6,045,439 A | | 4/2000 | Birang et al. | |
| 6,146,242 A | * | 11/2000 | Treur et al. | 451/6 |
| 6,190,234 B1 | * | 2/2001 | Swedek et al. | 451/6 |
| 6,261,151 B1 | * | 7/2001 | Sandhu et al. | 451/6 |

* cited by examiner

*Primary Examiner*—Derris H. Banks
(74) *Attorney, Agent, or Firm*—Crockett & Crockett; Daniel C. McKown, Esq.

(57) ABSTRACT

An optical sensor that includes a light source and a detector is located within a cavity in a polishing pad so as to face the surface that is being polished. Light from the light source is reflected from the surface being polished and the reflected light is detected by the detector. The electrical signal produced by the detector is conducted to a hub located at the central aperture of the polishing pad. The disposable polishing pad is removably connected, both mechanically and electrically to the hub. The hub contains electronic circuitry that is concerned with supplying power to the optical sensor and with transmitting the electrical signal to a non-rotating station. Several techniques are described for accomplishing these tasks. The system permits continuous monitoring of an optical characteristic of a surface that is being polished, even while the polishing machine is in operation, and permits the end point of the polishing process to be determined.

23 Claims, 5 Drawing Sheets

POLISHING PAD WITH BUILT-IN OPTICAL SENSOR

BACKGROUND OF THE INVENTION

1. Field of the Invention

The present invention is in the field of semiconductor wafer processing, and more specifically relates to a disposable polishing pad for use in a chemical mechanical polishing operation performed on the semiconductor wafers wherein the polishing pad contains an optical sensor for monitoring the condition of the surface being polished while the polishing operation is taking place to permit determination of the endpoint of the process.

2. The Prior Art

In U.S. Pat. No. 5,893,796 issued Apr. 13, 1999 and in continuation Pat. No. 6,045,439 issued Apr. 4, 2000, Birang et al. show a number of designs for a window installed in a polishing pad. The wafer to be polished is on top of the polishing pad, and the polishing pad rests upon a rigid platen so that the polishing occurs on the lower surface of the wafer. That surface is monitored during the polishing process by an interferometer that is located below the rigid platen. The interferometer directs a laser beam upward, and in order for it to reach the lower surface of the wafer, it must pass through an aperture in the platen and then continue upward through the polishing pad. To prevent the accumulation of slurry above the aperture in the platen, a window is provided in the polishing pad. Regardless of how the window is formed, it is clear that the interferometer sensor is always located below the platen and is never located in the polishing pad.

In U.S. Pat. No. 5,949,927 issued Sep. 7, 1999 to Tang, there are described a number of techniques for monitoring polished surfaces during the polishing process. In one embodiment Tang refers to a fiber-optic cable embedded in a polishing pad. This cable is merely a conductor of light. The light source and the detector that do the sensing are located outside of the pad. Nowhere does Tang suggest including a light source and a detector inside the polishing pad. In some of Tang's embodiments, fiber-optic decouplers are used to transfer the light in the optical fibers from a rotating component to a stationary component. In other embodiments, the optical signal is detected onboard a rotating component, and the resulting electrical signal is transferred to a stationary component through electrical slip rings. There is no suggestion in the Tang patent of transmitting the electrical signal to a stationary component by means of radio waves, acoustical waves, a modulated light beam, or by magnetic induction.

In another optical end-point sensing system, described in U.S. Pat. No. 5,081,796 issued Jan. 21, 1992 to Schultz there is described a method in which, after partial polishing, the wafer is moved to a position at which part of the wafer overhangs the edge of the platen. The wear on this overhanging part is measured by interferometry to determine whether the polishing process should be continued.

In conclusion, although several techniques are known in the art for monitoring the polished surface during the polishing process, none of these techniques is entirely satisfactory. The fiber optic bundles described by Tang are expensive and potentially fragile; and the use of an interferometer located below the platen, as used by Birang et al., requires making an aperture through the platen that supports the polishing pad. Accordingly, the present inventor set out to devise a monitoring system that would be economical and robust, taking advantage of recent advances in the miniaturization of certain components.

SUMMARY OF THE INVENTION

It is an objective of the present invention to provide a polishing pad in which an optical sensor is contained, for monitoring an optical characteristic, such as the reflectivity, of a wafer surface that is being polished, during the polishing operation. The real-time data derived from the optical sensor enables, among other things, the end point of the process to be determined.

It is a further objective of the present invention to provide apparatus for supplying electrical power to the optical sensor in the polishing pad.

It is a further objective of the present invention to provide apparatus for supplying electrical power for use in transmitting an electrical signal representing the optical characteristic from the rotating polishing pad to an adjacent non-rotating receiver.

It is a further objective of the present invention to provide a disposable polishing pad containing an optical sensor, wherein the polishing pad is removably connectable to a non-disposable hub that contains power and signal processing circuitry.

In accordance with the present invention, an optical sensor that includes a light source and a detector is disposed within a blind hole in the polishing pad so as to face the surface that is being polished. Light from the light source is reflected from the surface being polished and the reflected light is detected by the detector which produces an electrical signal related to the intensity of the light reflected back onto the detector.

The electrical signal produced by the detector is conducted radially inward from the location of the detector to the central aperture of the polishing pad by a thin conductor concealed between the layers of the polishing pad.

The disposable polishing pad is removably connected, both mechanically and electrically, to a hub that rotates with the polishing pad. The hub contains electronic circuitry that is concerned with supplying power to the optical sensor and with transmitting the electrical signal produced by the detector to non-rotating parts of the system. Because of the expense of these electronic circuits, the hub is not considered to be disposable. After the polishing pad has been worn out from use, it is disposed of, along with the optical sensor and the thin conductor.

In accordance with the present invention, electrical power for operating the electronic circuits within the hub and for powering the light source of the optical sensor may be provided by several techniques. In a preferred embodiment, the secondary winding of a transformer is included within the rotating hub and a primary winding is located on an adjacent non-rotating part of the polishing machine. In a first alternative embodiment, a solar cell or photovoltaic array is mounted on the rotating hub and is illuminated by a light source mounted on a non-rotating portion of the machine. In another alternative embodiment, electrical power is derived from a battery located within the hub. In yet another embodiment, electrical conductors in the rotating polishing pad or in the rotating hub pass through the magnetic fields of permanent magnets mounted on adjacent non-rotating portions of the polishing machine, to constitute a magneto.

In accordance with the present invention, the electrical signal representing an optical characteristic of the surface being polished is transmitted from the rotating hub to an adjacent stationary portion of the polishing machine by any of several techniques. In a preferred embodiment, the electrical signal to be transmitted is used to frequency modulate a light beam that is received by a detector located on adjacent non-rotating structure. In alternative embodiments, the signal is transmitted by a radio link or an acoustical link. In yet another alternative embodiment, the signal may be applied to the primary winding of a transformer on the rotating hub and received by a secondary winding of the transformer located on an adjacent non-rotating portion of the polishing machine. This transformer may be the same transformer that is used for coupling electrical power into the hub, or it can be a different transformer.

The novel features which are believed to be characteristic of the invention, both as to organization and method of operation, together with further objects and advantages thereof, will be better understood from the following description considered in connection with the accompanying drawings in which several embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

The wafers with which the present invention is used are composite structures that include strata of different materials. Typically, the outermost stratum is polished away until its interface with an underlying stratum has been reached. At that point it is said that the end point of the polishing operation has been reached. The polishing pad of the present invention is applicable to detecting transitions from an oxide layer to a silicon layer as well as to transitions from a metal to an oxide or other material.

Clearly, stopping a polishing machine to remove a wafer to inspect it and then replacing the wafer into the machine and starting the machine is a highly inefficient way of determining whether the process has been carried far enough. Ideally, with the present invention, the polishing process can be allowed to progress until the optical sensor of the present invention has provided information that permits a determination that the end point has been reached.

Although end point sensing is the main objective of the present invention, other possibilities for using the present invention are under consideration. These include determining how far away the end point is, sampling various areas on a wafer, and mapping the surface of a wafer. Although a single optical sensor is described in the following paragraphs, it is contemplated that for some uses of the invention a number of optical sensors may be included in a polishing pad.

The present invention involves modifying a conventional polishing pad by embedding within it an optical sensor and other components. The unmodified polishing pads are widely available commercially, and the Model IC 1000 made by the Rodel Company of Newark, N.J., is a typical unmodified pad. Pads manufactured by the Thomas West Company may also be used. The manner in which these pads are modified in accordance with the present invention and used will be clear from the discussion below.

In that discussion, it will be seen that the optical sensor of the present invention senses an optical characteristic of the surface that is being polished. Typically, the optical characteristic of the surface is its reflectivity. However, other optical characteristics of the surface can also be sensed, including its polarization, its absorptivity, and its photoluminescense (if any). Techniques for sensing these various characteristics are well known in the optical arts, and typically they involve little more than adding a polarizer or a spectral filter to the optical system. For this reason, in the following discussion the more general term "optical characteristic" is used.

The words "optical" and "light" as used below include unltraviolet, visible, and infrared types of light. The terms "radio" and "acoustic" are used in their usual broad sense.

Figure 1:
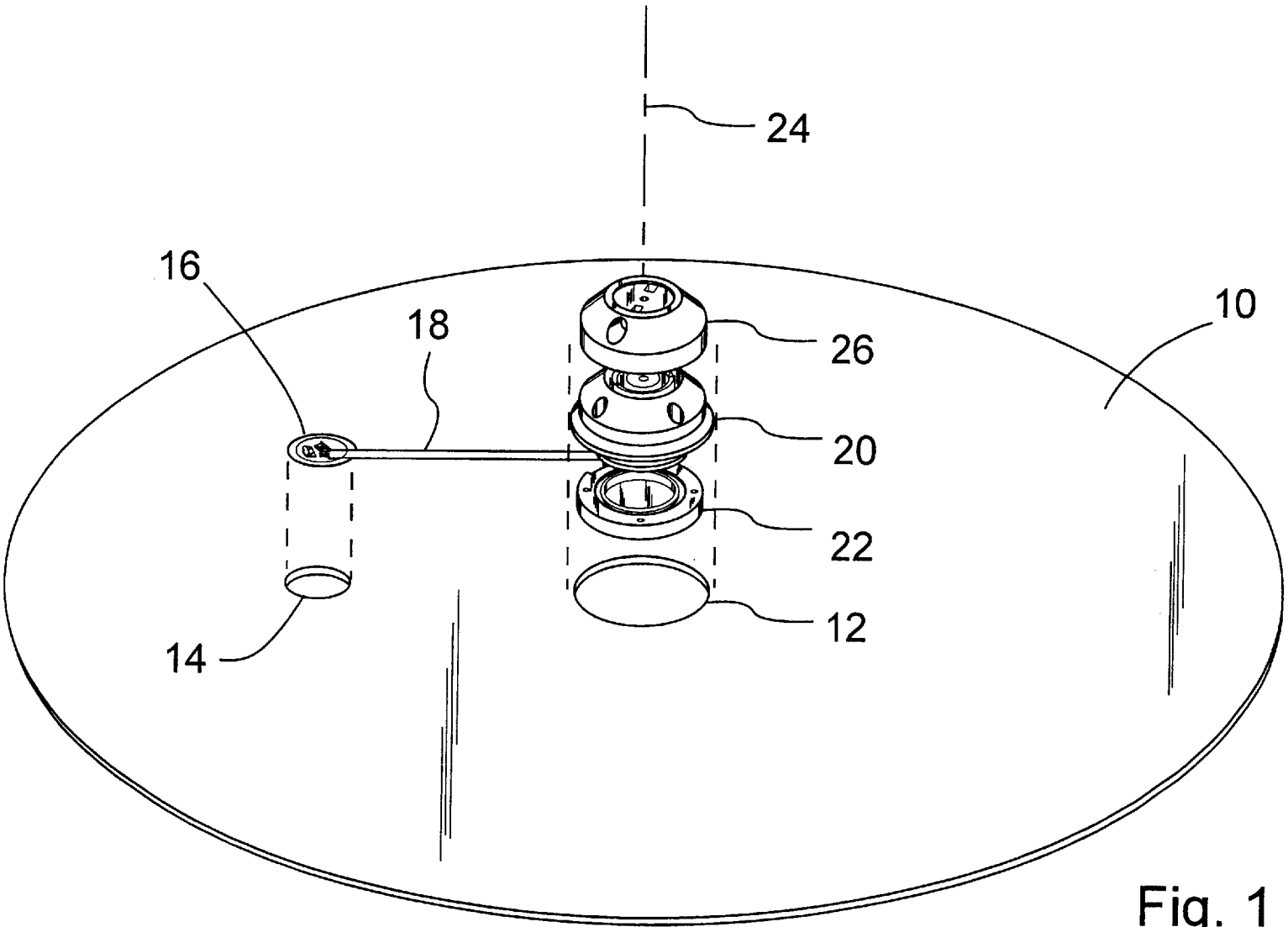
FIG. 1 is an exploded view in perspective showing the general arrangement of the elements of a preferred embodiment of the invention.

As shown in FIG. 1, the polishing pad 10 has a circular shape and a central circular aperture 12. In accordance with the present invention, a blind hole 14 is formed in the polishing pad, and the hole 14 opens upwardly so as to face the surface that is being polished. In accordance with the invention, an optical sensor 16 is placed in the blind hole 14 and a conductor ribbon 18, which extends from the optical sensor 16 to the central aperture 12, is embedded within the polishing pad.

Figure 4:
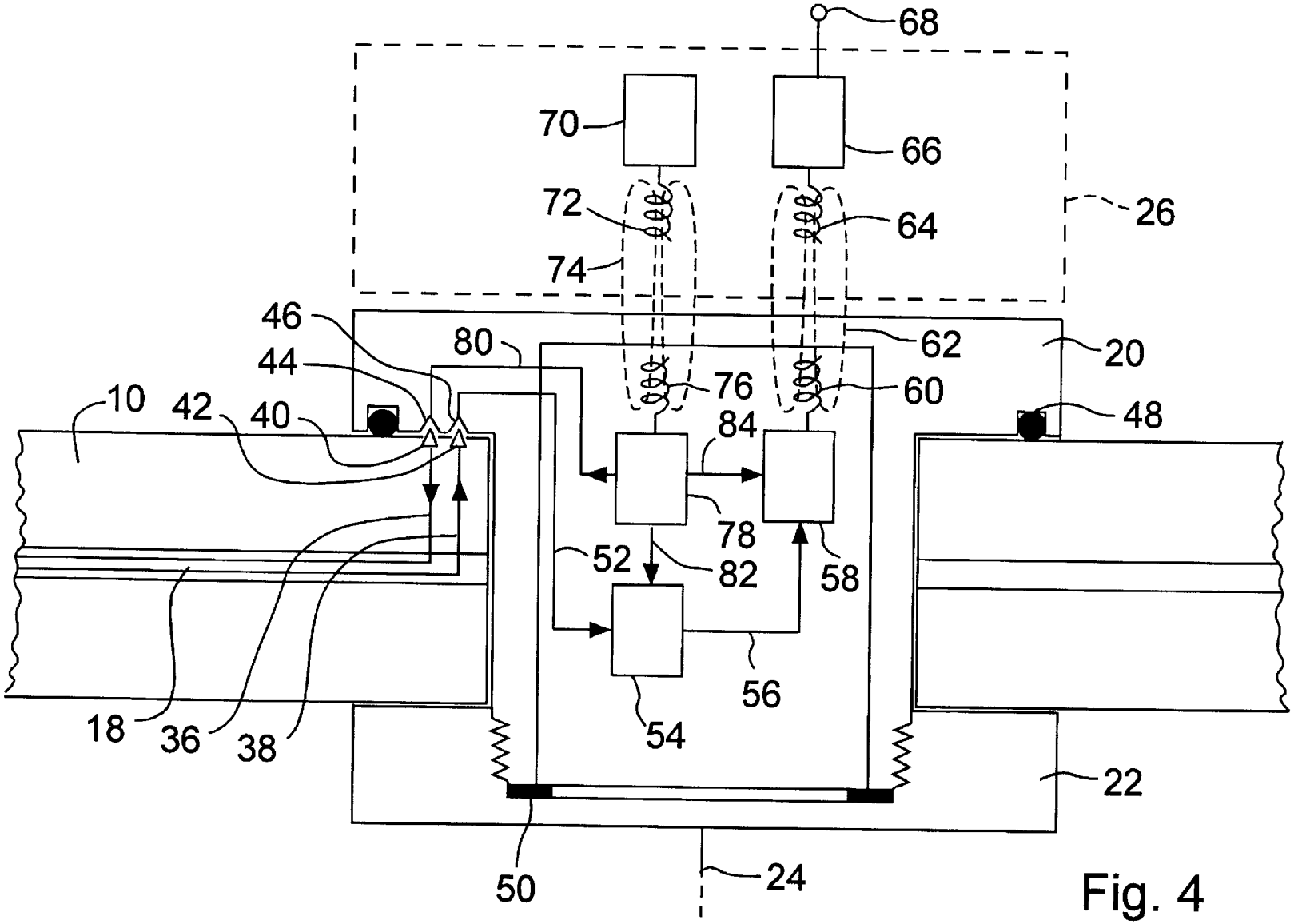
FIG. 4 is a diagram showing a medial cross sectional view of a hub in accordance with a preferred embodiment of the invention.

When the polishing pad is to be used, a hub 20 is inserted from above into the central aperture 12 and secured there by screwing a base 22, which lies below the polishing pad, onto a threaded portion of the hub 20. As best seen in FIG. 4, the polishing pad 10 is thus clamped between portions of the hub and portions of the base. During the grinding process, the polishing pad, the hub and the base rotate together about a central vertical axis 24.

Also seen in FIG. 1 and FIGS. 4–7 is a non-rotating portion 26 of the polishing machine. Preferably, it is located adjacent and above the hub 20. Although it is not considered to be part of the present invention, the non-rotating portion 26 is ancillary to the present invention and its purpose will be described more fully below.

Figure 2:
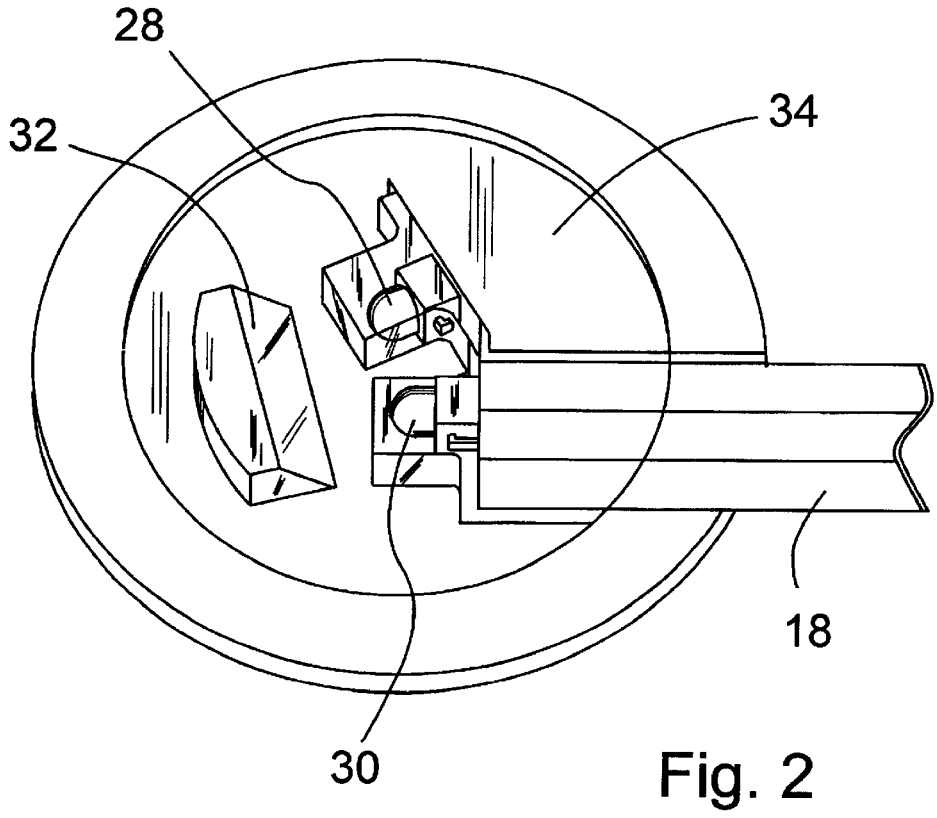
FIG. 2 is a front top perspective view of the optical sensor used in a preferred embodiment of the invention.

FIG. 2 is a top front perspective view showing the optical sensor 16, in a preferred embodiment, in greater detail. The optical sensor 16 includes a light source 28, a detector 30, a reflective surface 32, and the conductor ribbon 18. The conductor ribbon 18 includes a number of generally parallel conductors laminated together for the purpose of supplying electrical power to the light source 28 and for conducting the electrical output signal of the detector 30 to the central aperture 12. Preferably, the light source 28 and the detector 30 are a matched pair. In general, the light source 28 may be a light emitting diode and the detector 30 is a photodiode. The central axis of the bundle of light emitted by the light source 28 is directed horizontally initially, but upon reaching the reflective surface 32 the light is redirected upward so as to strike and reflect from the surface that is being polished. The reflected light also is redirected by the reflective surface 32 so that the reflected light falls on the detector 30, which produces an electrical signal in relation to the intensity of the light falling on it. The arrangement shown in FIG. 2 was chosen to conserve the height of the sensor.

Figure 3:
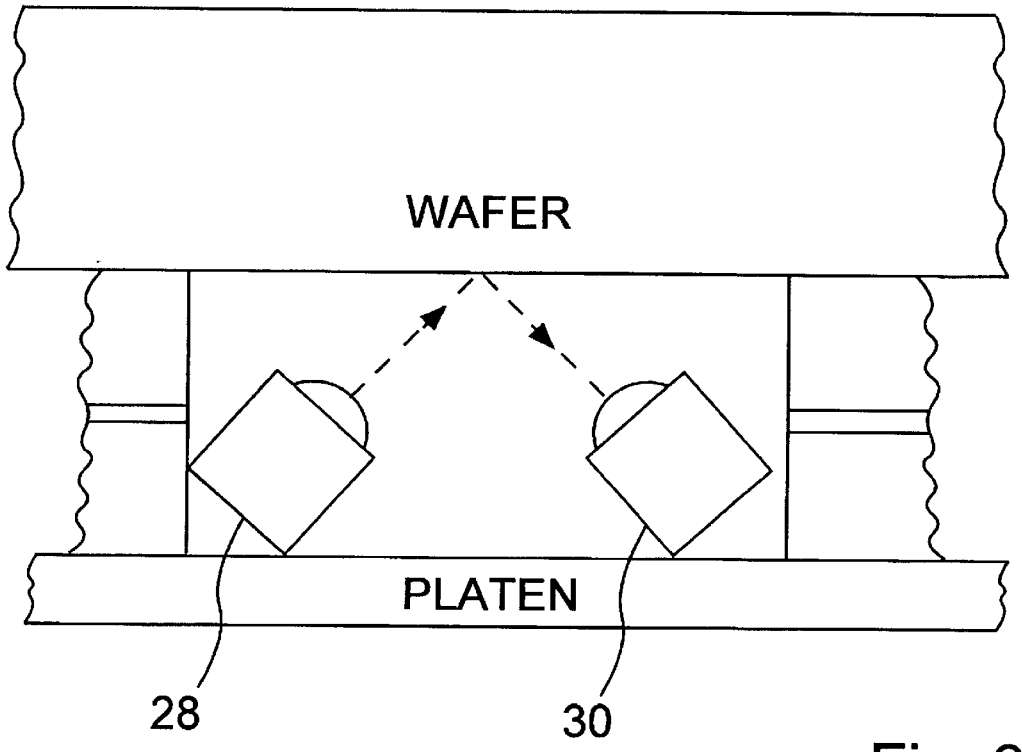
FIG. 3 is a side elevational diagram showing an optical sensor in an alternative embodiment of the invention.

As smaller light sources and detectors become available, it may be possible to dispense with the reflective surface 32 and instead to use the arrangement shown in side view in FIG. 3.

The optical components and the end of the conductor ribbon 18 are encapsulated in the form of a thin disk 34 that is sized to fit snugly within the blind hole 14 of FIG. 1. In the arrangements of FIGS. 2 and 3, it is understood that baffles may be used to reduce the amount of stray light reaching the detector.

Included within the conductor ribbon 18 are at least three conductors: a power conductor 36, a signal conductor 38, and one or more return or ground conductors, not shown.

As best seen in FIG. 4, the power conductor 36 terminates adjacent the central aperture 12 of the polishing pad 10 at a power plug 40, and the signal conductor 38 likewise terminates at a signal plug 42. When the hub 20 is inserted into the central aperture 12, the power plug 40 makes electrical contact with the power jack 44, and the signal plug 42 makes electrical contact with the signal jack 46. An O-ring seal 48 prevents the liquids used in the polishing process from reaching the plugs and jacks. Ajar lid type of seal 50 is provided in the base 22 to further insure that the electronic circuits within the hub remain uncontaminated.

An electrical signal produced by the detector 30 and related to the optical characteristic is carried by the conductor 52 from the signal jack 46 to a signal processing circuit 54, that produces in response to the electrical signal a processed signal on the conductor 56 representing the optical characteristic. The processed signal on the conductor 56 is then applied to a transmitter 58.

In the embodiment shown in FIG. 4, the transmitter 58 applies a time-varying electrical current to the primary winding 60 of a transformer that produces a varying magnetic field 62 representative of the processed signal. The magnetic field 62 extends upward through the top of the hub 20 and is intercepted by a secondary winding 64 of the transformer which is located on an adjacent non-rotating portion 26 of the polishing machine, or on some other non-rotating object. The varying magnetic field 62 induces a current in the secondary winding 64 that is applied to a receiver 66 that produces on the terminal 68 a signal representative of the optical characteristic. This signal is then available for use by external circuitry for such purposes as monitoring the progress of the polishing operation and/or determining whether the end point of the polishing process has been reached.

A similar inductive technique may be used to transfer electrical power from the adjacent non-rotating portion 26 of the polishing machine to the rotating hub 20. A prime power source 70 on the non-rotating portion 26 applies an electrical current to the primary winding 72 of a transformer that produces a magnetic field 74 that extends downward through the top of the hub 20 and is intercepted by a secondary winding 76 in which the varying magnetic field induces an electrical current that is applied to a power receiver circuitry 78. The power receiver 78 applies electrical power on the conductor 80 to the power jack 44, from which it is conducted through the power plug 40 and the power conductor 36 to the light source 28. The power receiver 78 also supplies electrical power to the signal processing circuit 54 through the conductor 82, and to the transmitter 58 through the conductor 84. At present, the magnetic induction technique is the best mode and preferred embodiment for transferring power into the rotating hub 20. In one embodiment the winding 60 is the same winding 76, and the winding 64 is the same winding 72. The superimposed power and signal components are at different frequency ranges in this embodiment and are separated by filtering.

Figure 5:
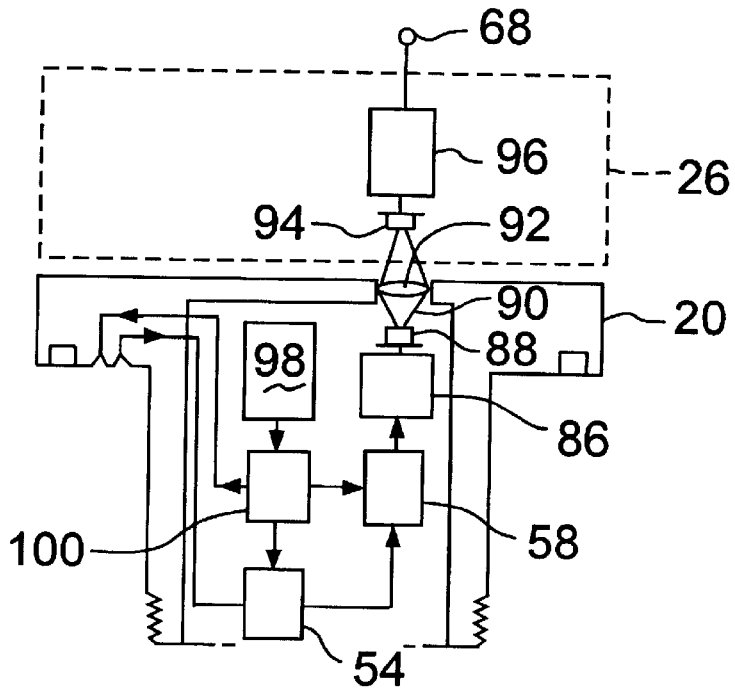
FIG. 5 is a diagram showing a medial cross sectional view of a hub in a first alternative embodiment of the invention.
Figure 6:
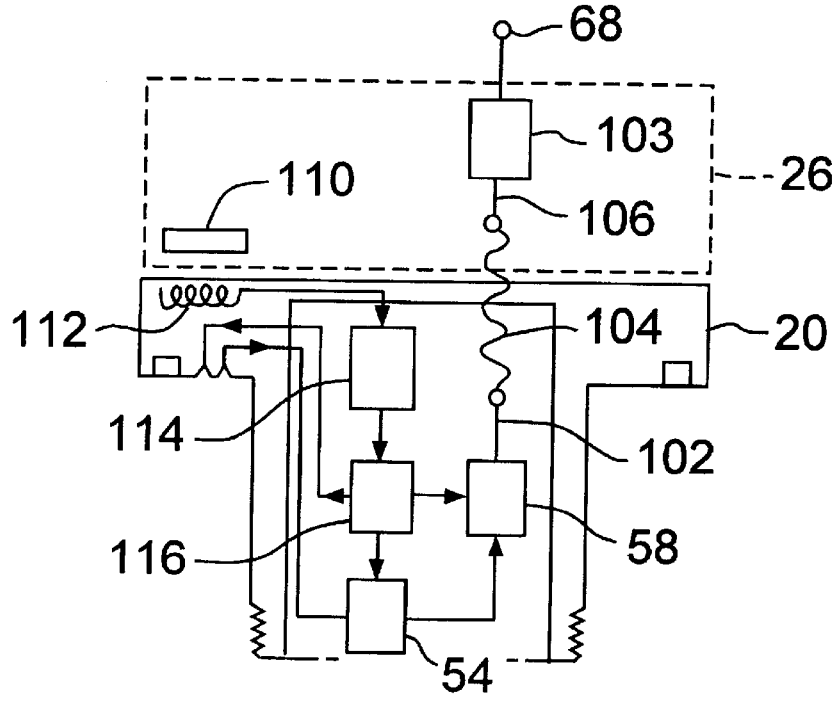
FIG. 6 is a diagram showing a medial cross sectional view of a hub in a second alternative embodiment of the invention; and, FIG. 7 is a diagram showing a medial cross sectional view of a hub in a third alternative embodiment of the invention.
Figure 7:
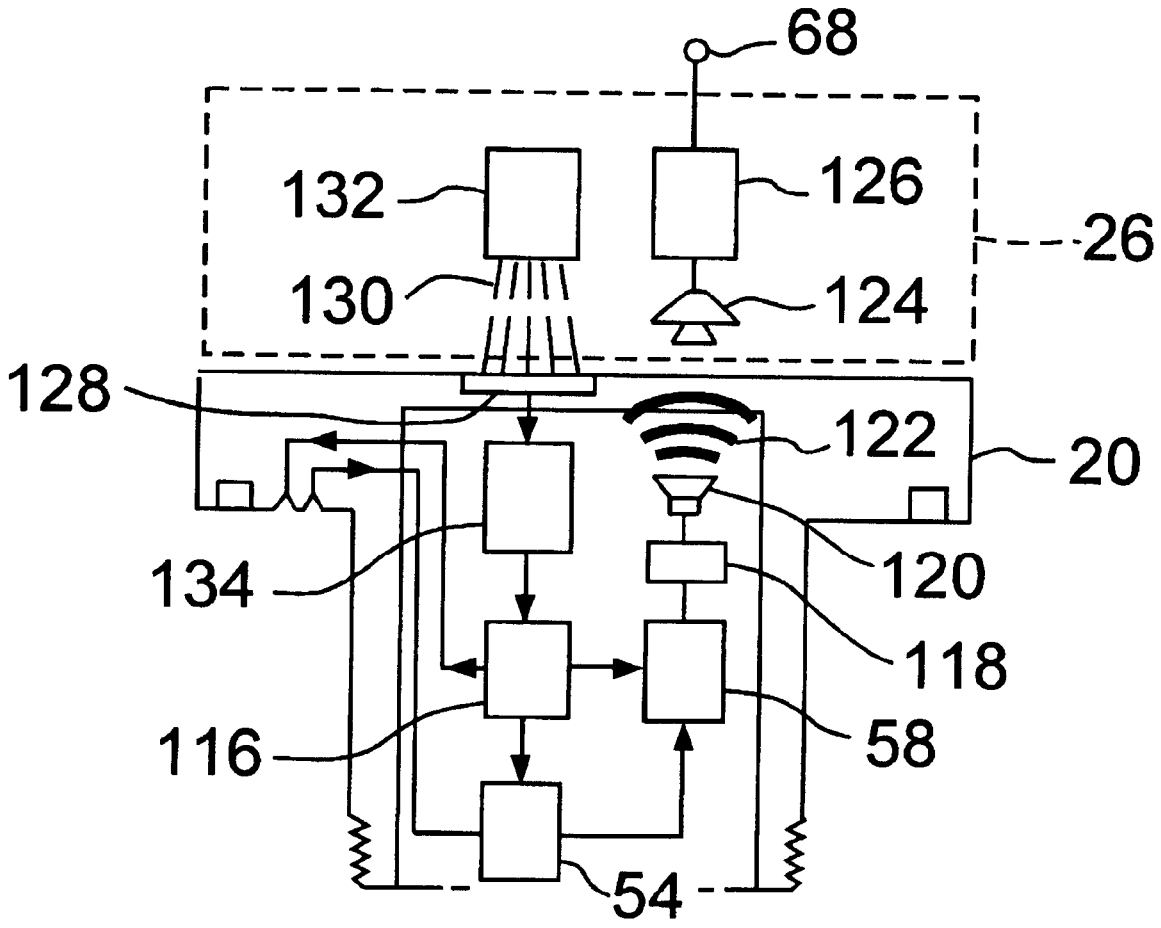

FIGS. 5–7 show alternative embodiments in which other techniques are used to transfer signals from the rotating hub 20 to a non-rotating portion 26 of the polishing machine, and to transfer electrical power from the non-rotating portion 26 into the rotating hub 20.

In the embodiment shown in FIG. 5, the transmitter 58 further includes a modulator 86 that applies to a light emitting diode or laser diode 88 a frequency modulated current representative of the processed signal that represents the optical characteristic. The light-emitting diode 88 emits light waves 90 that are focused by a lens 92 onto a photodiode detector 94. The detector 94 converts the light waves into an electrical signal that is demodulated in the receiver 96 to produce on the terminal 68 an electrical signal representative of the optical characteristic. At present, this is the best mode and preferred technique for transferring the electrical signal from the rotating hub 20 to the non-rotating portion 26 of the polishing machine.

Also, in the embodiment of FIG. 5, the prime source of electrical power is a battery 98 that supplies power to a power distribution circuit 100 that, in turn, distributes electrical power to the power jack 44, to the signal processing circuit 54, and to the transmitter circuit 58.

In the embodiment of FIG. 6, the transmitter 58 is a radio transmitter having an antenna 102 that transmits radio waves 104 through the top of the hub 20. The radio waves 104 are intercepted by the antenna 106 and demodulated by the receiver 103 to produce an electrical signal on the terminal 68 that is representative of the optical characteristic.

Also in the embodiment of FIG. 6, electrical power is generated by a magneto consisting of a permanent magnet 110 located in the non-rotating portion 26 and an inductor 112 in which the magnetic field of the permanent magnet 110 induces a current as the inductor 112 rotates past the permanent magnet 110. The induced current is rectified and filtered by the power circuit 114 and then distributed by a power distribution circuit 116.

In the embodiment of FIG. 7, the transmitter 58 further includes a power amplifier 118 that drives a loudspeaker 120 that produces sound waves 122. The sound waves 122 are picked up by a microphone 124 located in the non-rotating portion 26 of the polishing machine. The microphone 124 produces an electrical signal that is applied to the receiver 126 which, in turn, produces an electrical signal on the terminal 68 that is representative of the optical characteristic.

Also in the embodiment of FIG. 7 electrical power is generated in the rotating hub 20 by a solar cell or solar panel 128 in response to light applied to the solar panel 128 by a light source 132 located in the non-rotating portion 26. The electrical output of the solar panel 128 is converted to an appropriate voltage by the converter 134, if necessary, and applied to the power distribution circuit 116.

Thus, there has been described a polishing pad, for use in a chemical mechanical polishing operation, containing an optical sensor for monitoring the condition of the surface that is being polished, during the polishing operation. The polishing pad, including the optical system, is disposable, and is used with a non-disposable hub that contains circuitry for receiving the signal produced by the optical sensor, for processing the signal and for transmitting the signal to a non-rotating station. The hub also contains circuitry for supplying power to the optical sensor as well as to the other electronic circuits located in the hub. In the several embodiments described above, it is seen that the signal may be transmitted from the rotating hub to the non-rotating station by radio waves, sound waves, light waves, or by magnetic induction. Also, in the various embodiments, power may be supplied by including a battery in the hub or by coupling electrical power into the hub through a solar panel activated by externally applied light or by a magneto in which a stationary permanent magnet induces a current in an inductor that is mounted on the rotating hub.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. An article of manufacture comprising:

a polishing pad for use in performing a polishing operation on a surface of a wafer; and, optical means within said polishing pad for sensing an optical characteristic of the surface during the polishing operation.

2. The article of claim 1 wherein said optical means further include a light source for generating light.

3. The article of claim 2 wherein said light source is a light emitting diode.

4. The article of claim 2 wherein said light source is a solid state laser.

5. The article of claim 2 wherein said light source is oriented to illuminate the surface of the wafer.

6. The article of claim 5 wherein said optical means further include detector means for receiving light reflected by the surface of the wafer and for producing an electrical signal representative of the intensity of the light reflected.

7. The article of claim 6 further comprising conductor means within said polishing pad for conducting the electrical signal from said optical means to a central portion of said polishing pad.

8. The article of claim 7 wherein said conductor means further include an elongated flexible circuit board.

9. The article of claim 2 wherein said optical means further comprise a reflective surface oriented to reflect the light generated by said light source onto the surface of the wafer.

10. The article of claim 9 wherein said optical means further include detector means for receiving light reflected by the surface of the wafer and for producing an electrical signal representative of the intensity of the light reflected.

11. The article of claim 10 further comprising conductor means within said polishing pad for conducting the electrical signal from said optical means to a central portion of said polishing pad.

12. The article of claim 11 wherein said conductor means further include an elongated flexible circuit board.

13. An article of manufacture comprising:

a polishing pad for use in performing a polishing operation on a surface of a wafer, said polishing pad including a blind hole opening toward the surface of the wafer; and, optical means located in the blind hole for sensing an optical characteristic of the surface of the wafer during the polishing operation.

14. A hub, usable with a disposable polishing pad of a type containing an optical sensor for sensing an optical characteristic of a polished surface of a wafer during a polishing operation, for producing an electrical signal related to the optical characteristic, and for presenting the electrical signal at a signal conductor located at a central aperture of the polishing pad, said hub comprising:

electrical signal connector means mechanically adapted to removably receive the signal conductor to permit the electrical signal to enter the hub;

signal processing means connected to said electrical signal connector means for receiving the electrical signal and for producing in response to the electrical signal a processed signal representing the optical characteristic; and, transmitting means connected to said signal processing means for transmitting the processed signal.

15. The hub of claim 14 wherein said transmitting means further include means for emitting radio waves representative of the processed signal.

16. The hub of claim 14 wherein said transmitting means further include means for emitting sound waves representative of the processed signal.

17. The hub of claim 14 wherein said transmitting means further include means for emitting light waves representative of the processed signal.

18. The hub of claim 14 wherein said transmitting means further include means for producing a varying magnetic field representative of the processed signal.

19. The hub of claim 14 wherein the polishing pad is of a type that includes a power conductor extending from a central aperture of the polishing pad to the optical sensor for supplying electrical power to the optical sensor, and wherein said hub further comprises:

power receptor means for producing electrical power in response to externally applied energy; and, electrical power connector means mechanically adapted to removably receive the power conductor for applying to the power conductor the electrical power produced by said power receptor means.

20. The hub of claim 19 wherein said power receptor means further comprise a solar cell that produces electrical power in response to externally applied light.

21. The hub of claim 19 wherein said power receptor means further comprise an inductor that produces electrical power in response to variations in a magnetic field that passes through said inductor.

22. The hub of claim 14 wherein the polishing pad is of a type that includes a power conductor extending from a central aperture of the polishing pad to the optical sensor for supplying electrical power to the optical sensor, and wherein said hub further comprises:

a battery for producing electrical power; and, electrical power connector means mechanically adapted to removably receive the power conductor for applying to the power conductor electrical power produced by said battery.

23. The hub of claim 22 further comprising means electrically connecting said battery to said transmitting means for conducting electrical power from said battery to said transmitting means.

* * * * *